US006520295B1

(12) United States Patent
Sansevero et al.

(10) Patent No.: US 6,520,295 B1
(45) Date of Patent: Feb. 18, 2003

(54) PISTON-TYPE PASSENGER CONVEYING SYSTEM

(75) Inventors: Frank Sansevero, Glastonbury, CT (US); Gordon D. Row, Groton, MA (US); Gregg Draudt, Cambridge, MA (US); Jared Judson, Cambridge, MA (US); Daniel E. Rush, Canton, CT (US); Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/571,769

(22) Filed: May 16, 2000

(51) Int. Cl.[7] ..... B66B 1/18; B66B 1/20

(52) U.S. Cl. ..... 187/382; 187/383; 187/251; 187/258; 187/257

(58) Field of Search ..... 187/249, 251, 187/247, 382, 383, 257, 258; 254/294

(56) References Cited

U.S. PATENT DOCUMENTS

| | | | | |
|---|---|---|---|---|
| 2,771,160 A | | 11/1956 | Borden et al. | 187/29 |
| 3,750,849 A | | 8/1973 | Berkovitz | 187/16 |
| 3,831,715 A | * | 8/1974 | Matsuzawa et al. | 187/383 |
| 4,007,812 A | * | 2/1977 | Nelson, Jr. | 187/383 |
| 4,765,442 A | * | 8/1988 | Blain et al. | 187/382 |
| 4,819,766 A | * | 4/1989 | Saito | 187/382 |
| 5,584,364 A | * | 12/1996 | Sakita | 187/249 |
| 5,651,426 A | * | 7/1997 | Bittar et al. | 187/249 |

OTHER PUBLICATIONS

"Otis Supplies the Dresner Bank Building", Elevator World, vol. XLVII, No. 9, Sep. 1999, pp. 45–46.

* cited by examiner

*Primary Examiner*—Eileen D. Lillis
*Assistant Examiner*—Thuy V. Tran

(57) ABSTRACT

A piston-type passenger conveying system includes at least three cabs to move between two floors. A control moves the cabs such that a cab is always waiting at each of said floors, and another cab is always moving to a floor. In this way, the system achieves the passenger flow benefits of an escalator with the inherent benefits of an elevator system.

16 Claims, 3 Drawing Sheets

FIG.2A
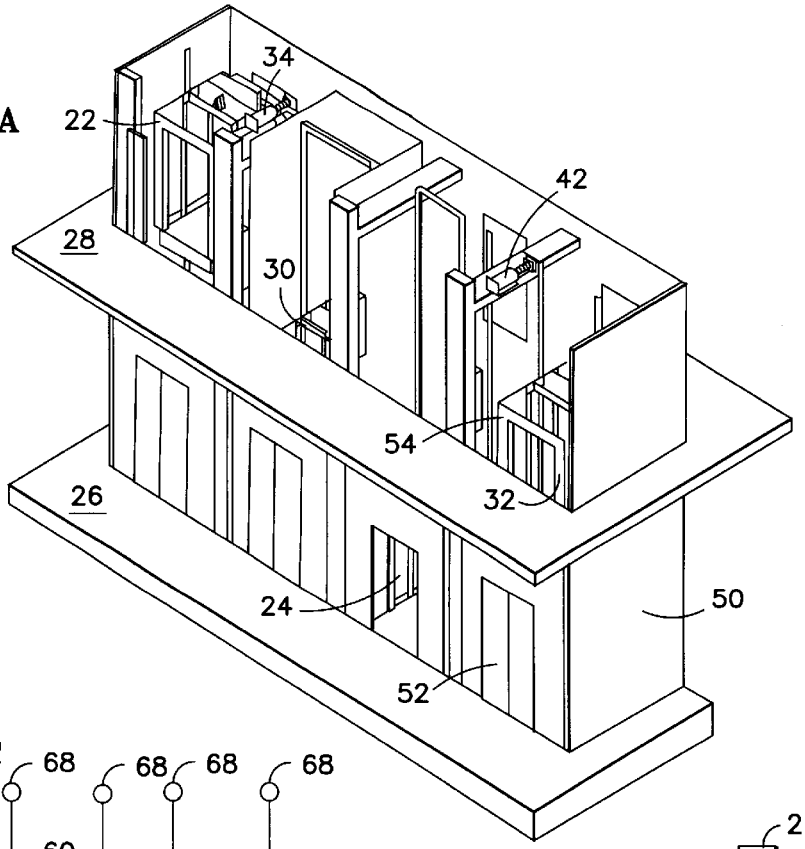
FIG.2C
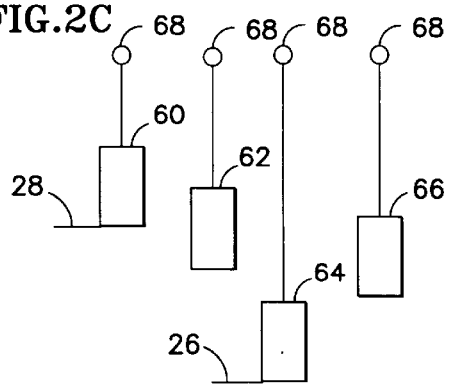
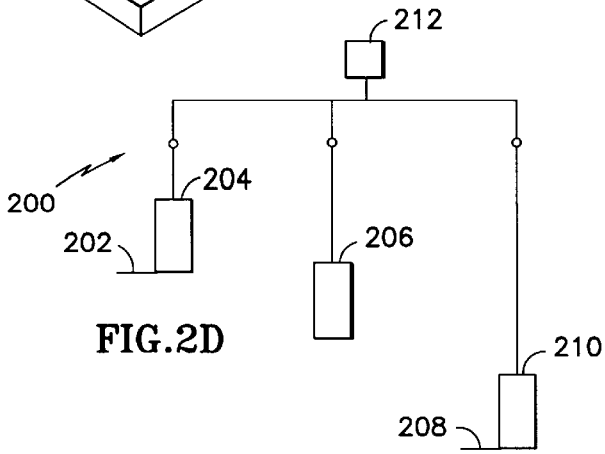
FIG.2D
FIG.2E
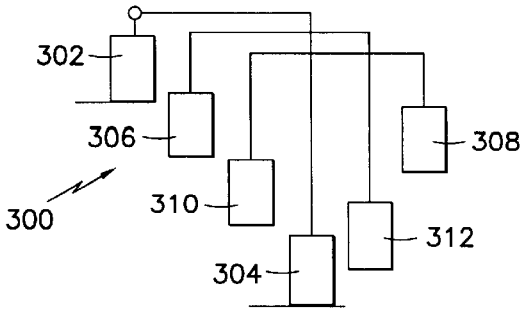
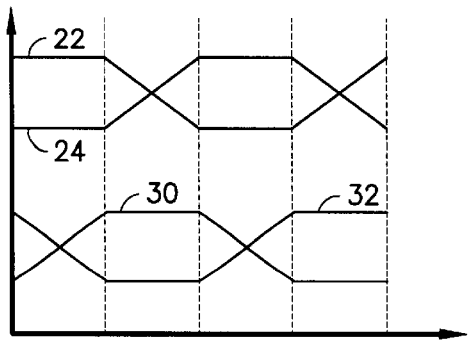
FIG.3

FIG.2B
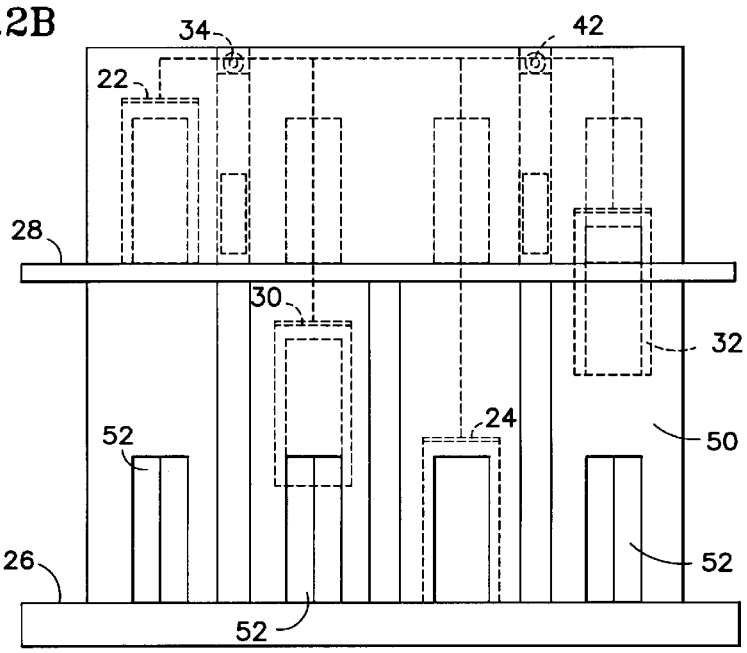
FIG.4A
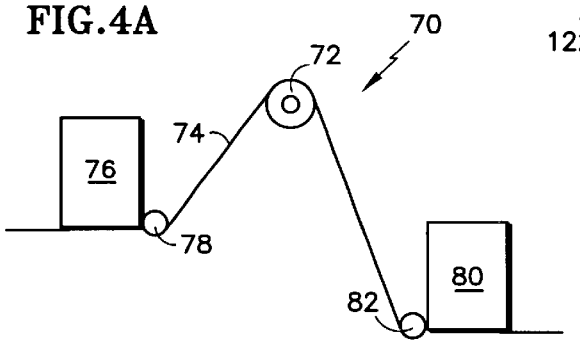
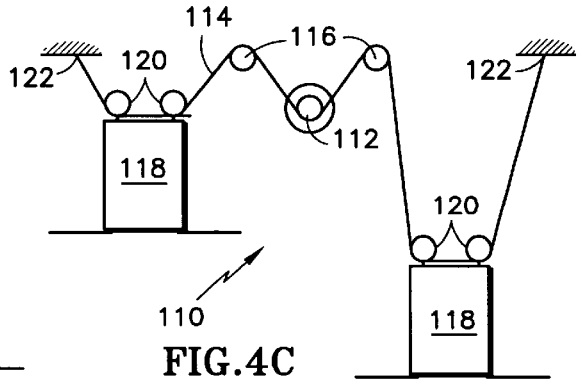
FIG.4C
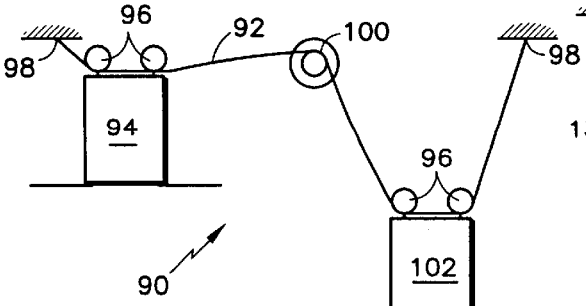
FIG.4B
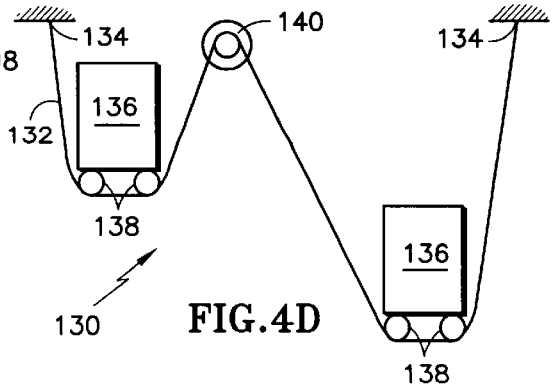
FIG.4D

PISTON-TYPE PASSENGER CONVEYING SYSTEM

BACKGROUND OF THE INVENTION

This invention relates to a piston-type passenger conveying system wherein elevator cabs are moved to be out of phase from each other and to move passengers between two floors continuously.

Typically, passengers are moved between the floors in low rise buildings such as malls, etc. by escalators. Escalators are widely utilized in most malls, although malls typically incorporate a few elevators. Known elevators dispatch cabs based upon a passenger call or request for a cab. The elevators do not move as many passengers as quickly as an escalator due to wait time, door opening time, dwell time, etc. Shoppers in a mall seem to prefer the escalators in that they move more quickly between the floors, and the movement is continuous without wait time. Also, shoppers may like the open nature of escalators as they can look around the mall.

Statistics show that an average escalator moves a much higher number of passengers than the elevators in such locations. However, escalators do have down sides. As examples, escalators do not move strollers, wheelchairs, etc. as well as do elevators.

It is thus the goal of this invention to propose an elevator-like system that has continuous flow of passengers like an escalator.

SUMMARY OF THE INVENTION

In disclosed embodiments of this invention, at least three elevator cabs are operated such that they are maintained out of phase from each other for movement between two floors. For purposes of this Application, the term "out of phase" used for the position of the cabs can be understood by first defining a cycle of movement. In normal operation, a control moves a plurality of cabs through a desired cycle of movement. The cycle of movement could be described as starting when a cab initially reaches a floor, then moves away to another floor, and eventually returns to the first floor. For purposes of this invention, the several cabs are maintained such that they are at different points in this cycle at different times relative to each other. In this sense they are "out of phase". The cycle of movement can be described as 360°, and thus three cabs are maintained 120° out of phase, four cabs are maintained 90° out of phase, etc. In one main aspect of this invention, a control system moves a plurality of elevator cabs based upon a cyclically changing desired position. Typically, cabs are moved to respond to a passenger call or request. The present invention discloses a system which control movement based solely on moving the cabs to a desired position such that there will be a cab at each floor at all times when the system is operating under normal conditions.

In a preferred embodiment, there are four cabs grouped into two pairs, with each of the two in a pair being maintained 180° out of phase from each other, and offset by 90° from the other pair. A control tries to maintain a cab always open at each of the two floors. Another cab is always moving toward each floor. For purposes of this application, the description "moving toward the other floor" would include the door opening time, etc. after arrival at the floor.

In the actual physical systems according to this invention, it may be that a cab will actually arrive at the floor to which it is heading before the cab at that floor leaves. Thus, for purposes of this Application, the invention is disclosed as having a cab usually moving to one of the floors, and one cab usually waiting at each of the floors. Further, it should be understood that the above-described control is under normal conditions. There may be other conditions such as a sleep mode, or a mode which is entered under particular periods of time, wherein this basic control is not operational. As one example only, in a system in a mall, it may be that the cabs are all generally moved to the first floor when the mall opens. However, under normal conditions, the above-discussed control will be in place.

Further, other numbers of cabs beyond four can be utilized. The system can operate with any number of cabs greater than two. Further, more than two pairs may be utilized. While several distinct numbers of cabs are disclosed, it should be understood that the main features of this invention can be achieved by any number of cabs greater than two.

In a preferred embodiment of this invention, the two cabs in the pair are driven by a single machine through a rope or cable. Preferred methods of moving the cab pairs are also disclosed.

These and other features of the present invention can be best understood from the following specification and drawings, the following of which is a brief description.

BRIEF DESCRIPTION OF THE DRAWINGS

FIG. 2A is a view showing the position of the four cabs and their drive machinery.

FIG. 2B is a front view of the FIG. 2A structure.

FIG. 2C shows a distinct embodiment.

FIG. 2D shows another embodiment.

FIG. 2E shows another embodiment.

FIG. 3 is a timing chart for controlling the movement of the four cabs.

FIG. 4A shows a first arrangement for driving two cabs in a pair.

FIG. 4B shows a second arrangement.

FIG. 4C shows a third arrangement.

FIG. 4D shown a fourth arrangement.

DETAILED DESCRIPTION OF A PREFERRED EMBODIMENT

Figure 1:
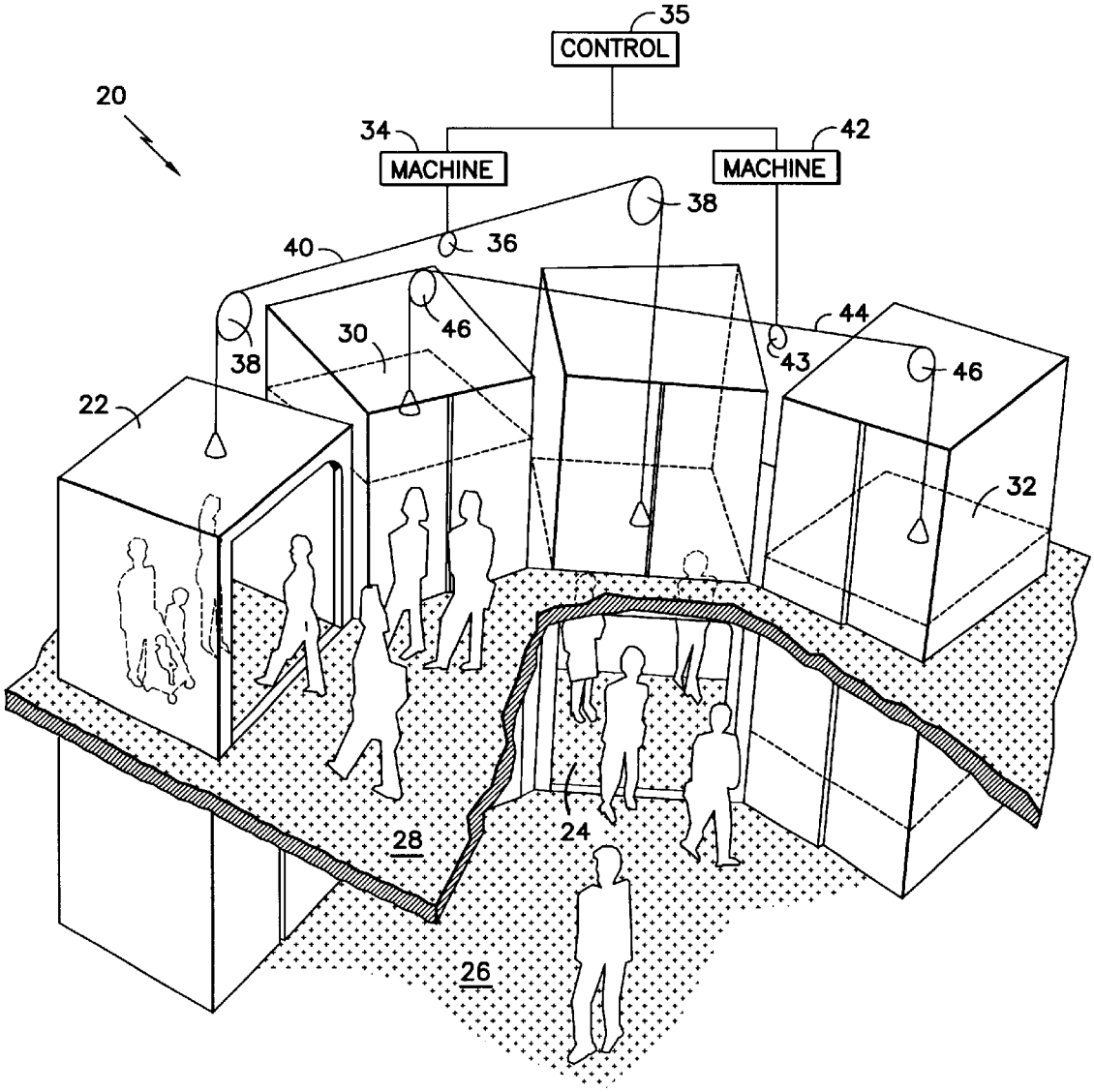
FIG. 1 is a highly schematic view showing the movement of four cabs according to the present invention.

A system 20 is illustrated in FIG. 1 having a cab 22 and a cab 24 awaiting passengers on respective floors 28 and 26. Another cab 30 is moving toward the floor 28 and a cab 32 is moving toward floor 26. Ideally, a cab will always be open for passengers at each of the floors. Thus, there is no wait time with system 20. This eliminates a major undesirable aspect of elevators to most consumers.

A machine 34 drives a sheave 36 to move a cable or wire 40 around sheaves 38. The cable 40 move the cabs 22 and 24 to be directly out of phase from each other in the movement between the floors 26 and 28. A similar machine 42 drives a sheave 43 to move cable 44 and around another sheave 46 to connect movement between the cabs 30 and 32. Again, the cabs 30 and 32 are maintained 180° out of phase from each other. The drive sheaves 36 and 43 are shown schematically. An appropriate sheave arrangement that would be able to transmit sufficient force to the cable 44 to move the cabs will be required. A worker in this art would be able to design such a sheave arrangement. A control 35, shown schematically, controls cab movement as described below.

As shown in FIG. 2A, the cab 22 is at the floor 28 and the cab 24 is at the floor 26. Cab 30 may be moving toward the floor 28 and cab 32 may be moving toward the floor 26. As seen, the machines are mounted adjacent one of the two cabs. As further can be appreciated from FIGS. 1 and 2A, the paired cabs are not immediately adjacent to each other, but instead are interspaced with cabs from the other pair. In this way, a passenger approaching the cab 22 just as its cab doors close would be in position to enter the next cab 30 which should have its doors immediately open. Similarly, the cab doors on cab 24 close just before the doors on cab 32 will open. Again, this will improve the continuous flow of passengers.

As also shown in FIG. 2A, each cab has walls 54, an outer housing 50 surrounds the entire system, and there are cab doors 52. It is preferred that the structure 50, 52 and 54 all be made of glass or clear plastic. It may be that portions of the structural components need be made of opaque metals. However, it is desirable that as much of the structure as possible be made of transparent materials. It is believed that passengers in a mall like to look around the mall during movement, and the clear structure will provide this benefit.

FIG. 2B is a view similar to the FIG. 2A, but showing a front view of the location of the cabs 22 and 24 at the floors. Moreover, as can be seen, the cabs 30 and 32 are moving to their respective floors. The machines 34 and 42 can be seen to be positioned between the two cabs in a pair.

FIG. 2C shows another embodiment for achieving the desired position of the elevator such as shown in FIGS. 2A or 2B. In FIG. 2C, elevators 60, 62, 64, and 66 are each driven by a separate machine 68, shown schematically, to move between the floors 26 and 28 in the same pattern as the prior embodiments. The machines 68 are shown schematically, and typically a counterweight would also be required, as known.

FIG. 2D shows a system 200 wherein a floor 202 has one cab 204, and another floor 208 has a cab 210 waiting. A further cab 206 is moving between the two floors. In this system, the three cabs have a single control, shown schematically at 212, maintaining the cabs 120° out of phase. The cabs each have a separate machine and counterweight.

The FIGS. 2A and 2B embodiment has advantages over the FIGS. 2C and 2D embodiments in that they may be smaller and less expensive. The FIGS. 2A and 2B embodiment will not require counterweights, or as many machines as the FIGS. 2C and 2D embodiments. On the other hand, the FIGS. 2C and 2D embodiments may be preferred for certain applications. The FIGS. 2C and 2D embodiments are able to more easily move away from the preferred cyclical movement of the cabs, which may sometimes be desirable. As an example, in some applications, it may be desirable to have several cabs at one of the floors at a particular period of time. When a mall first opens it may be desirable to have more of the elevators near the ground floor. With a system such as shown in FIG. 2C or 2D, there is greater control over the ability to position the cabs at a particular desired location at a given time.

FIG. 3 is a timing chart for the cabs 22, 24, 30 and 32. The same chart would apply to the FIG. 2C system. As can be appreciated, the cabs 22 and 24 are waiting on the floors as illustrated, while the cabs 30 and 32 are moving towards those floors in the first time frame. The cabs 30 and 32 are at respective floors in a second time frame with the cabs 22 and 24 moving to the opposed floor. The cycle continues with movement between the two floors for each of the four cabs. For purposes of this timing chart, the overall operation has been somewhat simplified. It may be that the time actually spent on the floor is increased to account for cab opening and cab door closing time relative to the movement time. However, for purposes of keeping the cab in phase as shown in FIG. 3, the door opening and door closing times would be seen as part of the movement ramps.

FIG. 2E shows an embodiment 300 wherein there are three pairs each having cabs 302 and 304, 306 and 312 and 310 and 308 maintained approximately 60° out of phase from each other. The control will generally be as described above; however, as should be well within the skill of a worker in this art, the time between a cab initially reaching and then leaving a floor may be reduced with this embodiment.

The passenger flow through this system may preferably be as disclosed in co-pending patent application Ser. No. 09/571,827, entitled "Improved Passenger Flow for Piston-Type Passenger Conveying Systems" and the control of the timing of FIG. 3 to adjust for real world problems is preferably as disclosed in a co-pending patent application Ser. No. 09/571,829, entitled "Dispatching Algorithm for Piston-Type Passenger Conveying Systems", both filed on even date herewith.

FIGS. 4A–4E show arrangements for supporting and counter balancing the two cabs in a pair.

As shown in FIG. 4A, the first embodiment 70 has one to one roping and is underslung. That is, a machine 72 is positioned to drive a cable 74 and move a cab 76 through a connection 78 near the bottom of the cab. The cable 74 is further connected to the bottom 82 of a cab 80 to move the cab 80. Of course, sheaves and other appropriate mount structures may be included into this embodiment. FIG. 4B shows an embodiment 90 wherein the cable 92 (driven by machine 100) drives a cab 94 through an overslung connection shown schematically at 96. The cable 92 is further fixed at 98 to a frame such the roping is 2-1. The cable 92 is connected after passing through an overslung connection 96 on a cab 102 to a frame at a second point 98.

A further embodiment 110 is shown in FIG. 4C having a machine 112 driving the cable 114 to move cabs 118 through an overslung connection 120, and fixed to the building frame at 122. In this embodiment, deflection sheaves 116 are positioned vertically above the machine 112.

FIG. 4D shows an embodiment 130 having a cable 132 connected to the building frame at 134. Cabs 136 are connected through an underslung connection 138 and driven by a machine 140.

Notably, the machines are preferably positioned between the two cabs. This provides a low overhead system with no need for a machine room. The machine may preferably be a long thin machine, i.e., having a diameter to length ratio less than one. The machine could also be disc shaped. This will minimize the required space between the two cabs. As the rope, the machine could use flat belts, or conventional round ropes. The rope could be metallic, non-metallic or a hybrid material. It is preferred that the rope and termination spring stiffness in the cab pair embodiments is maintained to be relatively high. In particular, it is desirable that a change in load from empty to full will cause a deflection of a car at the bottom floor of less than 6 mm. This will eliminate any need for a separate releveling device. Further, a single motor driving a pair of cabs will use a relatively low amount of power when the cabs are empty, or when the load in the two cabs is nearly equal. The high input power will only be required when there is a high upgoing load and a low downgoing load. This will result in significant energy savings. Further, using a single machine to drive a pair of cabs reduces the amount of associated equipment, such as elevator controllers, electric drives, machine brakes, etc. This reduces costs and increases reliability.

Although a particular drive mechanism has been disclosed, other drive mechanisms beyond traction drives may be utilized. As an example, hydraulic drive systems, drum drive systems, linear motor systems, self-propelled car systems, etc. may be substituted.

Although a preferred embodiment of this invention has been disclosed, a worker in this art would recognize that certain modifications would come within the scope of this invention. For that reason, the following claims should be studied to determine the true scope and content.

What is claimed is:

1. A passenger conveying system comprising:

at least three cabs that reciprocate between two floors, with a control having a normal cycle where it controls movement of the cabs based upon a desired cyclic position, with said desired cyclic position having at least one of said cabs at each of the two floors at most times, and at least one of said cab moving to each of said floors at most times.

2. A system as recited in claim 1, wherein there are at least four of said cabs grouped into pairs of two cabs which are 180° out of phase from each other.

3. A system as set forth in claim 2, wherein said cabs are arranged such that a cab from each of said pairs is adjacent to another cab from another of the pairs to improve the passenger flow time.

4. A system as set forth in claim 2, wherein each of said pairs has a single drive motor.

5. A system as set forth in claim 2, wherein each of said pairs has a single drive motor, which drives a cable that supports said two cabs of its associated pair.

6. A system as set forth in claim 5, wherein the cable driven by said drive motor supports said two cabs in an underslung arrangement.

7. A system set forth in claim 5, wherein the cable driven by said single drive motor supports said cabs in an overslung arrangement.

8. A system as set forth in claim 5, wherein said cable is fixed to a building frame at each of its two ends.

9. A system as set forth in claim 5, wherein said cable is fixed to said two cabs at its ends.

10. A system as set forth in claim 2, wherein there are four of said cabs divided into two pairs of two cabs each.

11. A system as set forth in claim 2, wherein said cabs counterbalance each other within each of said pairs.

12. A system as set forth in claim 1, wherein said cabs are surrounded in a housing that has transparent components.

13. A system as set forth in claim 1, wherein said cabs are each driven by separate motors.

14. A system as set forth in claim 13, wherein there are three of said cabs maintained 120° out of phase from each other.

15. A passenger conveying system comprising:

at least four cabs divided into pairs, such that there are at least two pairs of cabs, each of said pair of cabs being driven by a single motor to move between two floors; and a control for controlling movement of said cabs under normal conditions and having a desired normal cycle in which usually each of said two floors has one of said cabs located thereat, and usually each of said two floors has another of said cabs moving thereto, with said cabs located at said two floors being one of said pairs, and said cabs moving to said two floors being another of said pairs.

16. A system as set forth in claim 15, wherein at least some of the structural components surrounding said cabs are transparent.

* * * * *